United States Patent [19]

McIntosh

[11] 4,340,147

[45] Jul. 20, 1982

[54] CAP WITH BUILT IN PIERCING DEVICE

[75] Inventor: James A. McIntosh, Montclair, N.J.

[73] Assignee: Mack-Wayne Plastics Company, Wayne, N.J.

[21] Appl. No.: 203,357

[22] Filed: Nov. 3, 1980

[51] Int. Cl.[3] ..... B65D 51/24

[52] U.S. Cl. ..... 215/226

[58] Field of Search ..... 215/250, 257, 228, 226; 206/222

[56] References Cited

U.S. PATENT DOCUMENTS

| | | | |
|---|---|---|---|
| 2,009,392 | 7/1935 | Demmler | 222/83 |
| 2,771,218 | 11/1956 | Henderson | 222/83 |
| 3,521,745 | 7/1970 | Schwartzman | 206/222 |
| 4,022,258 | 5/1977 | Steidley | 215/250 |

FOREIGN PATENT DOCUMENTS

| | | | |
|---|---|---|---|
| 2153446 | 5/1973 | Fed. Rep. of Germany | 215/257 |
| 2437391 | 2/1975 | Fed. Rep. of Germany | 215/257 |
| 1192817 | 5/1970 | United Kingdom | 206/222 |
| 2020253 | 11/1979 | United Kingdom | 222/83 |

*Primary Examiner*—Donald F. Norton

*Attorney, Agent, or Firm*—Eugene E. Renz, Jr.

[57] ABSTRACT

A dual function cap member for a necked container having a material dispensing opening and a closure seal membrane securely attached thereover. The cap member is double sided and reversable. One side of the cap member has means coactable with the container neck to form a container closure cap. The reverse side of the cap has closure seal membrane piercing means operative, upon removal and reversal of the cap member from the closure cap position, to pierce and spread open the central area of the membrane. A peripheral portion of the so-pierced and opened membrane remains securely attached to the container neck about the dispensing opening for continued attachment of the membrane material to the container neck. The cap member, subsequent to membrane piercing, and possible dispensing of material from the container, is again operative, upon reversal, to serve as a selectively removable container closure cap to close and seal the dispensing opening.

5 Claims, 6 Drawing Figures

CAP WITH BUILT IN PIERCING DEVICE

TECHNICAL FIELD

The present invention relates generally to containers or packages that contain a material to be selectively dispensed therefrom. Some such containers are provided with membrane seals securely attached or affixed over a dispensing opening, the sealing membrane serving to insure or guarantee that the contents of the container remain unadulterated until dispensed by the ultimate user of the material. Such a sealing membrane also serves to guarantee that the material in the container has not been switched or replaced prior to purchase and use by the ultimate user.

Packages or containers of this nature can be of varying or different configurations and are used for packaging of different materials. Normally, such containers are provided with closure caps which are initially affixed to the container over the sealing membrane for security and integrity of the package. When it is desired to use or dispense the material from the container, such covers or caps must be removed and the sealing membrane then ruptured or pierced to permit dispensing of the material.

The present invention is primarily directed to containers of this type and more particularly to a dual function closure cap for the containers. The cap member is double sided and reversable, in one position serving as a closure cap for the container and, subsequent to removal and reversal of position, serves to rupture or pierce the sealing membrane and spread open the central area thereof while permitting a peripheral portion of the so-pierced and opened membrane to remain securely attached to the container neck about the dispensing opening. This prevents detachment of the ruptured or pierced membrane, or a portion thereof, and insures against contaminating dislodgement into the dispensed material or into the material remaining in the container.

BACKGROUND OF THE INVENTION

Containers for materials which are to be selectively dispensed therefrom are known and have been used for containing numerous specific materials. Depending upon the material to be contained and the ultimate user thereof, such containers have, generally speaking, many different shaped, are constructed of many different materials and are provided with different types of closure and/or dispensing attachments or means.

There has been a recent trend for oil companies, for example, to package some of their motor oil in plastic bottles of different sizes rather than cans or cardboard containers or the like. These containers or packages are primarily adapted and useful for sale in supermarkets and self-service gas stations and the like. Such containers can, of course, be used for packaging of many specifically different materials or substances such as automobile engine oils, outboard motor oils, and the like. The use of plastic bottles renders it easier and cleaner for customer use and containers specifically adapted for use in this area can be provided with different configurations and lengths of dispensing necks.

Normally, such plastic bottles will be capped with regular plastic screw caps and the containers in use will not require piercing spouts such as generally used in connection with oils packaged in cans or similar containers. As is well known, the use of piercing spouts with cans tends to result in user and/or container contamination by the oil.

When using plastic bottles to contain materials such as motor oil and which would be capped with regular plastic screw caps, normally a special liner or membrane is attached securely over the dispensing outlet to guarantee that the oil or contents is unadulterated and has not been switched. A problem then exists that such membrane must be broken or pierced before the material can be dispensed from the container. To some extent, the use of such a sealing membrane defeats the purpose of easy and clean use of such a plastic bottle or container.

Prior usages of plastic bottles or the like for the above mentioned purposes have, accordingly, had some drawbacks and have not found widespread acceptance and use by the oil packaging industry.

SUMMARY OF THE INVENTION

The present invention, accordingly, is broadly directed to plastic bottles or containers, preferably for packaging of oil and for sale in supermarkets and self-service gas stations to an ultimate consumer or user.

More specifically, the present invention is directed to a closure cap for plastic bottles of a type having a dispensing neck which is threaded to receive an interiorly threaded plastic screw cap thereon for closure purposes. The cap member of the present invention differs from the usual type, however, in that it is a dual function cap having two sides and is reversable. One side is interiorly threaded for coaction with threads on a dispensing neck of a container and the opposite or reverse side is provided with a built-in piercing or membrane seal rupturing device. Additionally, the screw threaded side is provided with a special compressible liner so that it can serve to tightly close and seal the neck of the bottle subsequent to rupturing of the sealing membrane and dispensing of a portion of the material from the bottle. This feature insures that the bottle can be of appropriate size to contain materials in quantities for incremental or repeated dispensing or use.

It will therefor be seen that the present invention provides a dual function closure cap for necked containers of plastic material having dispensing opening sealing means and the cap serves dual functions, i.e., to securely cap the container prior to dispensing of material therefrom and the same cap, upon removal from the bottle, can be positionally reversed and used to rupture or pierce the sealing membrane. Subsequent removal and reversal adapts the dual function cap to again serve to seal and close the bottle.

Still other objects and advantages of the present invention will become readily apparent to those skilled in the art from the following detailed description, wherein there is shown and described only a single preferred embodiment of the invention, simply by way of illustration of a best mode presently contemplated for carrying out the invention. As will be realized, the invention is capable of other and specific embodiments, and its several details are capable of modification in various, obvious respects, all without departing from the invention. Accordingly, the drawings and description are to be regarded merely as illustrative in nature, and not as restrictive.

BRIEF DESCRIPTION OF THE DRAWING

The accompanying drawing illustrates a preferred embodiment of the invention and, when taken together with the description, serves to explain the principals of the invention.

DETAILED DESCRIPTION OF PREFERRED EMBODIMENTS

Figure 2:
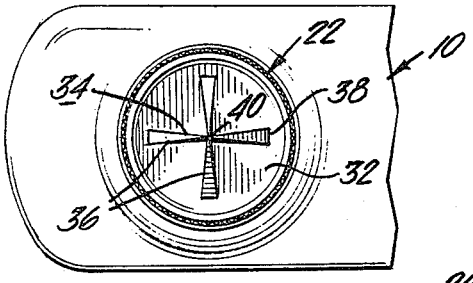
FIG. 2 is a fragmentary plan view of the container and cap as shown in FIG. 1.
Figure 5:
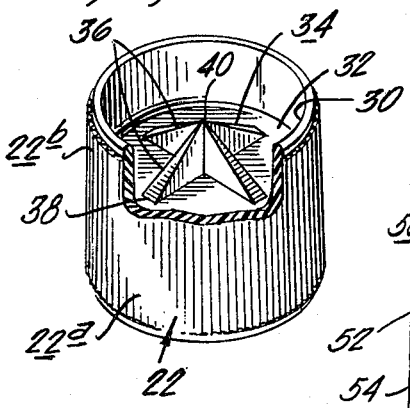
FIG. 5 is a perspective view of that side of a cap showing a form of membrane piercing means, a portion being broken away for clarity of disclosure.

Referring now in detail to the drawings, there is shown, fragmentarily, a material container preferably consisting of a plastic bottle, generally designated 10, which can include a handle fragmentarily shown at 12 and a dispensing neck 14. The dispensing neck 14 can be of any desired length and in the embodiment shown is provided with exterior screw threading 16. The bottle can be formed in any usual manner and of any plastic which will serve the needs of the packager and user, such as material inertness, frangibility, flexibility, weight, cost of manufacture and procurement, etc. All of these factors are well known in the art and do not constitute a part of the present invention.

The container embodiment shown has been devised with the particular intention of containment of motor oil or the like. It is highly desireable that motor oil be unadulterated when acquired and used by the ultimate user or consumer and care must also be taken that the oil has not been mixed or otherwise adulterated. To this end the dispensing neck has its dispensing opening 18 sealed by means of an aluminum sealing membrane 20 which is securely attached to the material of the neck 14 about the periphery of the dispensing opening. The affixation and sealing of such aluminum sealing membranes is likewise known in the art and need no further elucidation herein. It will also be understood that the sealing membrane can consist of other materials providing that it has the sealing facility or characteristics, either by adhesive use, heat application, or the like and, which at the same time, is readily pierceable or rupturable as will be explained in greater detail hereinafter. In practice, after the container 10 is filled with material to the desired extent, the sealing membrane 20 is affixed over the dispensing opening 18.

Figure 3:
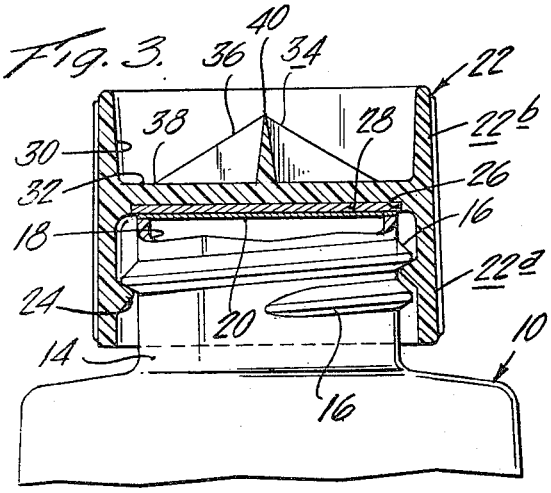
FIG. 3 is a fragmentary sectional view taken on line 3—3 of FIG. 1 and disclosing in greater detail the dual or two sided concept of the cap structure, the disclosure of FIG. 3 showing the cap in a container closure position.

Since the sealing membrane, regardless of the material from which formed, is of relatively easily pierceable or frangible nature, protective means consisting of a usual type of cap must be provided. To this end, and for other purposes hereinafter to be described, a cap member 22 is provided and which is operatively engaged on the neck as shown in FIG. 3. The cap member 22, which is of the essence of the invention, departs from normal cap constructions. Preferably, the cap is formed of polypropylene, or other suitable material but is of a double sided and reversable construction. A first side 22A of the cap is generally cup shaped as is usual and is interiorly provided with threads at 24 for coacting engagement with threads 16 on dispensing neck 14 of the container. The inner end of cap side 22A is preferably provided with a circular recess 26 in which is mounted a sealing liner 28 of a type known in the art and which preferably is of sightly compressible material which is either impervious to petroleum materials or which can include a facing cover or material to the same end result.

It will be noted from FIG. 3 of the drawings that in the assembled relationship the cap 22 has the sealing line 28 engaged over the sealing membrane 20 about the periphery 18 of the dispensing opening. The container, when so filled and closed, is disseminated in commerce for ultimate sale to a consumer or user of the materials in the container.

Figure 6:
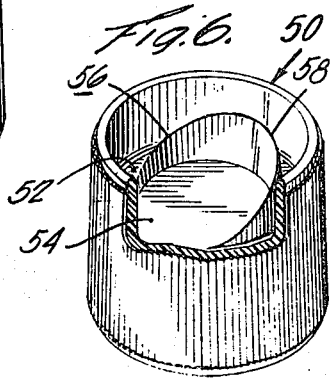
FIG. 6 is a view similar to FIG. 5 and disclosing a modification of the cap structure.
Figure 1:
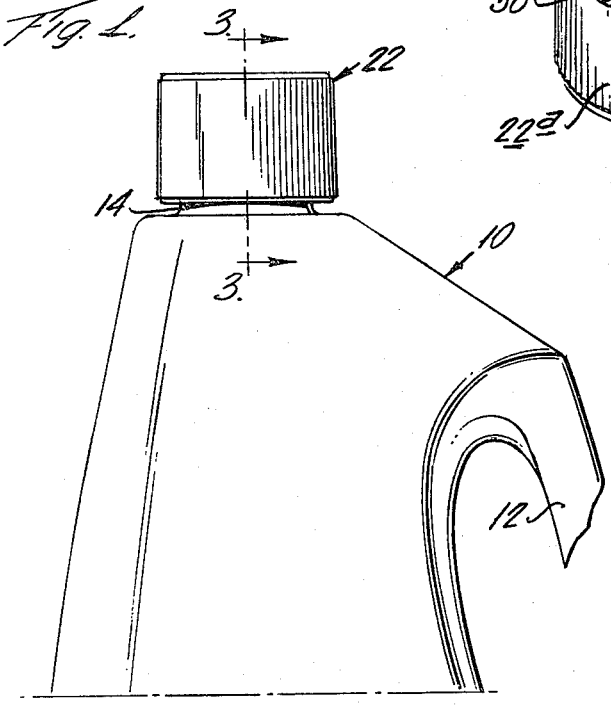
FIG. 1 is a fragmentary elevational view of a container or bottle for material having a closure cap thereon.

A second or reverse side or end 22B of cap member 22 is also provided with a recess generally indicated at 30 and which preferably is of a regressive conical configuration. The inner end 32 of recess 30 has formed thereon, preferably in the manufacture of the cap member, a piercing member or means, generally designated 34. As is shown more particularly in FIGS. 2, 3, 4 and 5 of the drawings, this piercing member consists of, generally speaking, a piercing cone shape, which consists of a plurality of triangular shaped sides or segments 36 decreasing in width from the base 38 toward a sharp piercing peak or apex 40. Obviously, the exact configuration of piercing member 34 can vary and a single variation is shown in FIG. 6 of the drawings, to be described hereinafter. In any event, the construction of piercing member 34 must include a sharp piercing surface or edge.

Figure 4:
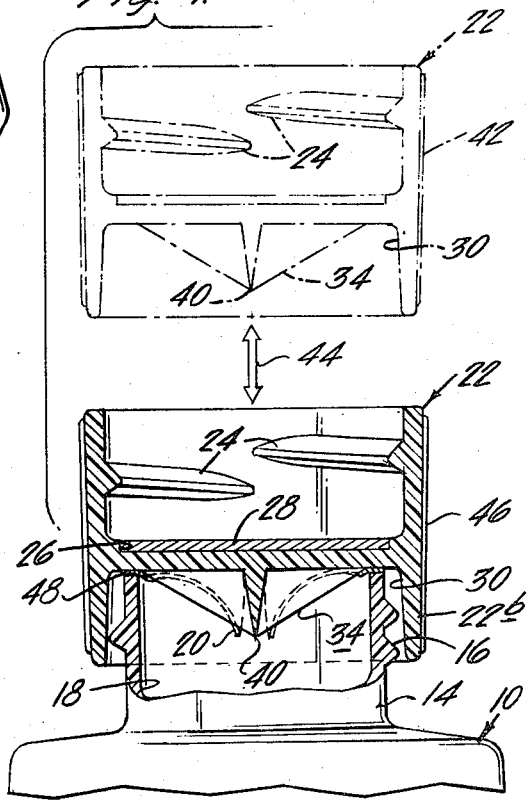
FIG. 4 is a fragmentary exploded view of the container and cap of FIG. 3 but with the cap having been removed and positionally reversed and serving to rupture a sealing membrane on the container dispensing neck.

In order to dispense the material from the container 10, following acquisition by the ultimate user, the cap 22 is unscrewed from the position shown in FIG. 3 of the drawings, is then reversed to the position shown in broken lines at 42, is downwardly moved as indicated by arrow 44 to the position shown in full lines at 46 in FIG. 4. It will here be noted that the regressive conical configuration of recess 30 in side 22B of cap member 22 facilitates placement of the recess over and around neck 14 of the container 10 as so reversed. As shown in FIG. 4, the apex or peak 40 of piercing member 34 has pierced or penetrated through the material of aluminum sealing membrane 20 at initial contact therebetween, and upon further depression or movement of the cap into the position indicated at 46 in full lines in FIG. 4, serves to open or spread the central area of the membrane, while at the same time a peripheral portion 48 of the membrane remains in continued sealed attachment about dispensing opening 18 of dispensing neck 14. This action, while serving so effectively open the dispensing opening of the container, further serves to maintain the material of membrane 20 from either dropping into the interior of the container to contaminate or adulterate the materials contained therein or, upon removal of the cap subsequent to piercing of the membrane, permit dispensing of material from the container while preventing portions of the membrane seal from becoming detached from the container and passing with the contents of material being dispensed into, for example, an internal combustion engine together with possible damage thereto.

After the desired amount of material has been dispensed from container 10, the cap can be again reversed to the position shown in FIG. 3, whereupon sealing liner 28 will again engage over the dispensing opening, in superposed position over peripheral portion 48 of membrane 20 remaining surmounted around the peripheral edge of the dispensing opening. The container obviously is then resealed to protect the contents therein and to prevent leakage of any remaining amounts of material from the container.

FIG. 6 discloses a specifically different embodiment of the invention. The cap, generally indicated at 50 in FIG. 6, is again double ended or sided and reversable. The first side or end, not shown, is provided with internal threads similar to the first embodiment, for mating coaction with the threads on the container neck in the manner shown in FIG. 3. The opposite end or side, however, is provided with a recess 52 at the bottom 54 of which there is provided a member configured as a fragmented circle or truncated fragmented cylinder 56 having a penetrating or piercing edge 58 which serves the same function as the piercing member 34 of the preceeding embodiment. When used in the manner shown in FIG. 4, the configuration or embodiment of FIG. 6 will serve to pierce and penetrate sealing membrane 20, spreading the central portion thereof while at the same time leaving the peripheral segment contacted and attached to the periphery about the dispensing opening for the same purpose as hereinbefore described. It is accordingly possible to reseal or reclose the container and no fragmented or detached portions of the membrane 20 are free to separate from the container.

Conceivably, the configuration disclosed in FIG. 6 could constitute or comprise a pouring spout by having a removable sealing liner therein.

Under some circumstances it might be desireable to differently shape the container. The length of the dispensing neck can be varied, and could be in the nature of a long, spout-like neck for dispensing use.

It will thus be seen that the present invention teaches a dual function cap member which serves not only as a container cap closure but contains a built-in sealing member piercing device or member. The cap can be easily and inexpensively manufactured, and is easy in use to open a container for dispensing the material and resealing the same. The necessity of a separate piercing and dispensing member for the container contents is obviated. A tamper- and adulteration-proof membrane can be placed on the container and readily opened by the piercing member of the invention as desired, and contamination of the material by fragmented portions of the membrane is not possible.

The structure, function and advantages of the present invention will be readily understandable from the foregoing description of preferred embodiments when taken together with the drawings.

Many other possible variations in specifics of components or details of the invention will be apparent to those skilled in the art. While in the present disclosure, there are shown preferred embodiments of the invention, it is to be understood that the invention is capable of changes or modifications without departing from the spirit and the scope of the inventive concept as expressed herein.

What is claimed is:

1. A dual function cap for a container having a sealed discharge opening, said cap being of generally elongated tubular configuration and having a dividing wall therebetween defining a pair of open ended cup-like cap portions, means on the inner periphery of the sidewalls of one of said cap portions for detachably mounting over the discharge opening of the container, piercing element contained in the other cap portion projecting from the dividing wall toward the open end of said other cap portion, tapered sidewalls within the other cap portion of regressive conical configuration extending a predetermined distance beyond all portions of the piercing element functioning to centrally guide the piercing element onto the sealed discharge opening of the container.

2. A dual function cap for a container as claimed in claim 1 wherein said means for detachably mounting said container includes internally disposed screw threads operative to threadedly engage said container.

3. A dual function cap for a container as claimed in claim 1 wherein said piercing element includes a plurality of triangular sections substantially perpendicular to and superimposed adjacent to said dividing wall, each of said triangular sections having side faces substantially perpendicular to said dividing wall which converge to form a raised sharp apex, said triangular sections also including front faces defining edges, and said front faces decreasing in width from the dividing wall to said apex of said piercing element.

4. A dual function cap for a container as claimed in claim 1 wherein said piercing element includes a truncated cylinder substantially perpendicular to said dividing wall and having end segments which increase in height and converge to define a raised sharp apex.

5. A dual function cap for a container as claimed in claim 1 wherein said cap is made of plastic.

* * * * *